United States Patent [19]

Gilman et al.

[11] Patent Number: 5,030,517

[45] Date of Patent: Jul. 9, 1991

[54] PLASMA SPRAYING OF RAPIDLY SOLIDIFIED ALUMINUM BASE ALLOYS

[75] Inventors: Paul S. Gilman, Suffern, N.Y.; Michael S. Zedalis; Santosh K. Das, both of Randolph, N.J.

[73] Assignee: Allied-Signal, Inc., Morris Township, Morris County, N.J.

[21] Appl. No.: 467,071

[22] Filed: Jan. 18, 1990

[51] Int. Cl.[5] ..... B22F 7/04

[52] U.S. Cl. ..... 428/549; 419/9; 419/33; 428/553; 428/937

[58] Field of Search ..... 419/9, 33; 428/549, 428/553, 937

[56] References Cited

U.S. PATENT DOCUMENTS 4,379,720 4/1983 Ray et al. ..... 75/251

*Primary Examiner*—Stephen J. Lechert, Jr.

*Attorney, Agent, or Firm*—Ernest D. Buff; Gerhard H. Fuchs

[57] ABSTRACT

A rapidly solidified aluminum base alloy is formed into a powder and plasma sprayed onto a substrate to provide a uniform and contiguous coating. Deposition and retention of the alloy onto the substrate are effected in a single process step. The coating exhibits improved mechanical and physical properties including excellent corrosion and oxidation resistance and improved elevated temperature strength and thermal stability.

27 Claims, 3 Drawing Sheets

PLASMA SPRAYING OF RAPIDLY SOLIDIFIED ALUMINUM BASE ALLOYS

BACKGROUND OF THE INVENTION

1. Field of the Invention

This invention relates to a process for improving the properties of materials, and more particularly to a process for producing a metallic coating from a rapidly solidified metal.

2. Description of the Prior Art

Spray metallizing consists of heating a metal to a molten or semi-molten condition by passing it through a high temperature heat source, and depositing it in a finely divided form on a substrate. The molten or semi-molten particles flatten out on impacting the substrate and adhere to its surface. Subsequently deposited particles also flatten out, and adhere to those previously deposited, thus the structure of sprayed deposits is lamellar. The sprayed metal deposits resemble the derivative wire or powder chemically, but their physical properties, especially their microstructure, are quite different from those of the original wrought metal. Cohesion is achieved through mechanical and metallurgical bonding. After being sprayed, certain materials can be fused to form a dense and uniform coating that is metallurgically bonded to the substrate. Fused coatings usually are required for protecting the substrate material during service of high temperatures, in abrasive and corrosive environments, or for developing a surface of uniformly high hardness. For example, sprayed aluminum coatings on steel require heating to above 482° C. to metallurgically bond the coating to the steel. Typically, the material may be subsequently heated at 732° C. to 1093° C. to provide a dense, uniform coating metallurgically bonded to the base metal.

Problems may arise due to the spray metallizing of aluminum coatings and subsequent diffusing of the aluminum spray coating from the formation of coarse aluminum-iron intermetallics dispersed within the deposited articles and at the coating/substrate interface. These intermetallics are very brittle and can degrade the mechanical properties of the component, for example, by forming a brittle layer between the components. Also, because the sprayed aluminum coating requires a thermal diffusing treatment, conditions may exist wherein the substrate material may not be properly heat treated. Problems may be encountered with welded aluminum coated steel parts. The alloying of the aluminum and iron can create a loss of ductility and lowering of corrosion resistance in the weld and heat-affected zone. Finally, because of the mismatch in the coefficient of thermal expansion between the sprayed aluminum coating and the substrate, the coating may degrade and spall off during high temperature exposure.

SUMMARY OF THE INVENTION

The present invention provides an economical and efficient process for plasma spraying aluminum base alloys in which no subsequent thermal treatment is required. Advantageously, such properties, as high temperature strength and stability, corrosion and oxidation resistance and compatibility with the substrate, of an aluminum spray metallized coating are improved in accordance with the invention by plasma spraying a rapidly solidified, high temperature aluminum alloy onto a designated substrate. This procedure, referred to hereinafter as plasma spraying, results in the formation of a high temperature spray metallized coating. Subsequent thermal treatment, such as heating the coating to above the solidus temperature of the alloy, heretofore required to adhere the coating to the substrate are virtually eliminated. Deposition and retention of a rapidly solidified alloy onto a substrate are effected in a single process step. The coated substrate exhibits improved ambient and elevated temperature mechanical and physical properties due to the microstructure of the resultant rapidly solidified coating.

Briefly stated, the invention provides a process for producing a rapidly solidified aluminum base alloy coating, comprising the steps of: (a) forming a rapidly solidified aluminum base alloy into a powder; and (b) plasma spraying said powder onto a substrate. The powder has a particle size less than US Standard Sieve size No. 3.5 (5.6 mm) and preferably between No. 60 and No. 325 (250–45 micrometers) when sprayed in a molten state onto a substrate using plasma spraying to form a nearly fully dense spray metallized coating. Moreover, the attractive properties of the rapidly solidified powder are retained. This process may be repeated such that the subsequent spraying is done on top of the sprayed coating. The sprayed metal coatings may then be finished by typical metal finishing operations such as machining, grinding, burnishing and polishing (provided that the precautions usually followed for sprayed metallized coatings are taken). Also, components having the spray metallized coatings can withstand moderate forming operations such as drawing, spinning, brake and roll forming, and embossing.

The plasma sprayed coatings are suitable for use in components requiring corrosion, oxidation and elevated temperature protection for use as aerospace components such a turbine blades, turbine vanes and fasteners; automotive components such as exhaust pipes, intake valves and cylinder barrels; and industrial components such as heat exchangers, fasteners for chemical piping and boilers, reactor tubes, and heat treating equipment. Applications, such as molds appointed for subsequent casting, may arise that specifically utilize the higher temperature capability, i.e. hardness, of the rapidly solidified coating. Alternatively, the plasma sprayed layers can be used for repairing coatings as well as engineering shapes made directly from the rapidly solidified materials. Specifically, the coating can be applied to a substrate to repair a surface defect thereof. The plasma sprayed layers can also be used to make the preforms for various composite materials wherein the substrate consists of continuous or woven fibers, bundles, whiskers or particulate made from a hard or semi-hard material such as refractory carbides, oxides or nitrides.

Also, the rapidly solidified alloys may be combined with a reinforcing phase to form a composite as described in U.S. patent application Ser. No. 242,989, filed Sept. 12, 1988, which description is incorporated herein by reference thereto, prior to being plasma sprayed onto a substrate.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1:
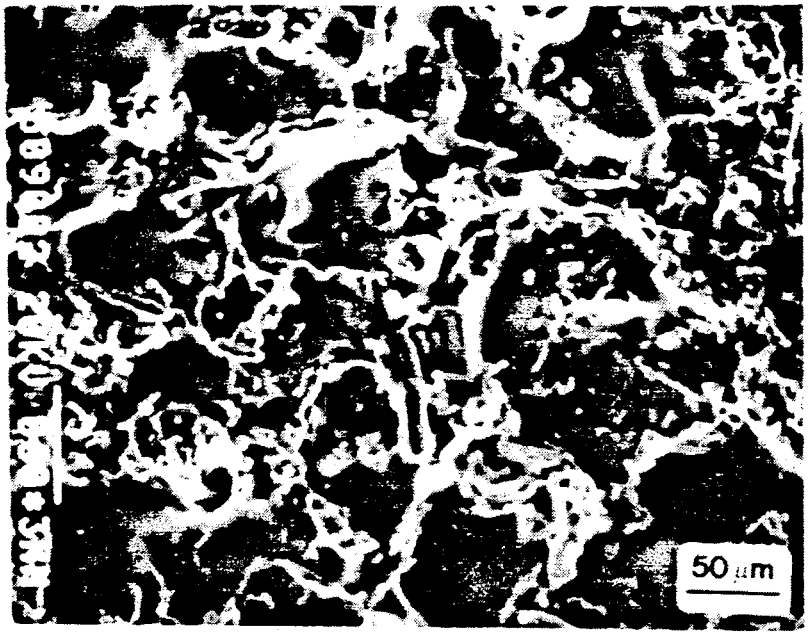
FIG. 1 is a scanning electron photomicrograph of the surface of a direct current (d.c.) plasma sprayed preform composed of rapidly solidified aluminum based iron, vanadium and silicon containing alloy matrix uniformly deposited onto a low carbon steel sheet fabricated by the present invention.

The aluminum base, rapidly solidified alloy appointed for use in the process of the present invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5–8.5 at %, "b" ranges from 0.25–5.5 at %, "c" ranges from 0.05–4.25 at % and the balance is aluminum plus incidental impurities, with the proviso that the ratio [Fe+X]:Si ranges from about 2.0:1 to 5.0:1. Examples of the alloy include aluminum-iron-vanadium-silicon compositions wherein the iron ranges from about 1.5–8.5 at %, vanadium ranges from about 0.25–4.25 at %, and silicon ranges from about 0.5–5.5 at %.

Another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5–7.5 at %, "b" ranges from 0.75–9.5 at %, "c" ranges from 0.25–4.5 at % and the balance is aluminum plus incidental impurities, with the proviso that the ratio [Fe+X]:Si ranges from about 2.01:1 to 1.0:1.

Still another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, Ce, Ni, Zr, Hf, Ti, Sc, "a" ranges from 1.5–8.5 at %, "b" ranges from 0.25–7.0 at %, and "c" ranges from about 0.05 to 4.25 at %, the balance being aluminum plus incidental impurities.

Still another aluminum base, rapidly solidified alloy that is suitable for use in the process of the invention has a composition range consisting essentially of about 2–15at % from the group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

A low density aluminum-lithium base, rapidly solidified alloy suitable for use in the present process has a composition consisting essentially of the formula $Al_{bal}Zr_aLi_bMg_cT_d$, wherein T is at least one element selected from the group consisting of Cu, Si, Sc, Ti, B, Hf, Cr, Mn, Fe, Co and Ni, "a" ranges from 0.05–0.75 at %, "b" ranges from 9.0–17.75 at %, c ranges from 0.45 to 8.5 at % and "d" ranges from 0.05 to 13 at %, the balance being aluminum plus incidental impurities.

Those skilled in the art will also appreciate that other dispersion strengthened, rapidly solidified or mechanically alloyed alloys or composites may be appointed for use as the coating material in the process of the present invention. One mechanical alloyed material that is suitable is that disclosed in the aforementioned application Ser. No. 242,987, filed Sept. 12, 1988. Specifically, the powder can be composed of rapidly solidified alloy combined with the particles of a reinforcing material present in an amount ranging from about 0.1 to 50 percent by volume, the powder having been ball milled to enfold metal matrix material around each of the particles.

The metal alloy quenching techniques used to fabricate these alloys generally comprise the step of cooling a melt of the desired composition at a rate of at least about $10^{5}$° C./sec. Generally, a particular composition is selected, powders or granules of the requisite elements in the desired portions are melted and homogenized, and the molten alloy is rapidly quenched on a chill surface, such as a rapidly moving metal surface, an impinging gas or liquid.

When processed by these rapid solidification methods the aluminum alloy is manifest as a ribbon, powder or splat of substantially uniform microstructure and chemical composition. The substantially uniformly structure ribbon, powder or splat may then be pulverized to a particulate for plasma spraying onto a substrate.

The substrate may be water or gas cooled, or may be heated directly or indirectly during the processing. The optimum substrate temperature is dependent on the rapidly solidified alloy and the dispersed phases which must be formed during solidification. The rapidly solidified alloy in the form of powder that can range in size less than U.S. Standard Sieve Size 3.5 (5.6 mm) and preferably within the range No. 60-No. 325 (250–45 micrometers) may then be plasma sprayed onto the substrate. The plasma spraying process comprises the steps of (i) ionizing an inert gas to generate a plasma; (ii) injecting said powder into said plasma; (iii) controlling the residence time of said powder within said plasma to cause said powder to reach a molten state; and (iv) directing said molten powder onto said substrate. The ionized gas plasma is created, for example, by either a direct current (d.c.), induction coupled or radio frequency power source. Direct current plasma spraying may be performed using a 20 to 40 kW power source and more preferably between 25 to 35 kW of power. Powder flow rate into the ionized plasma is dependent on the velocity of the gas exiting the nozzle of the d.c. plasma spraying unit, for if the powder is introduced into the plasma at too slow of a flow rate it will be blown back and will not enter the plasma, and if the powder is introduced at too rapid a rate, the powder will only partially melt before it impinges on the substrate. Induction coupled plasma spraying may be performed using a 140 to 200 kW power level and more preferably between 150 to 170 kW of power. Powder flow rates into the ionized plasma gas are dependent only on the liquidus temperature of the alloy and the temperature of the plasma. Induction coupled plasma spraying differs from d.c. plasma spraying in that the powder residence time in the plasma is estimated to be approximately 70 times greater; thus, larger powder particles can be injected into the plasma and complete melting will occur. The term "optimum flow rate", as used herein, means introducing powder into the plasma at a rate such that (1) the powder is not rejected by the plasma and (2) the powder is completely melted prior to impingement and solidification on the substrate. The term "optimum vacuum level" means regulating the vacuum level in the respective plasma spraying chambers such that (1) the molten powder droplets do not solidify prior to impinging on the substrate, and (2) excessive heating of the substrate does not occur. Excessive heating of the substrate will adversely affect the solidification rate of the deposited molten droplets and cause degradation of the deposited layer of powder.

Plasma spraying may be performed for varying lengths of time depending on the coating thickness required. Moreover, the attractive microstructure, excellent mechanical and physical properties of the rapidly solidified powder are retained. Specifically, the plasma sprayed metallized coatings exhibit in combination substantially the same corrosion, oxidation and elevated temperature strength and stability as is produced when the rapidly solidified aluminum base alloy is consolidated using powder metallurgical techniques. This process may be repeated such that subsequent spraying is done on top of the sprayed coating, and multi-layered coatings may be fabricated.

The sprayed coatings require no diffusion treatment as the plasma sprayed material retains the attractive microstructure and mechanical and physical properties of the rapidly solidified powder.

EXAMPLE I

Figure 2:
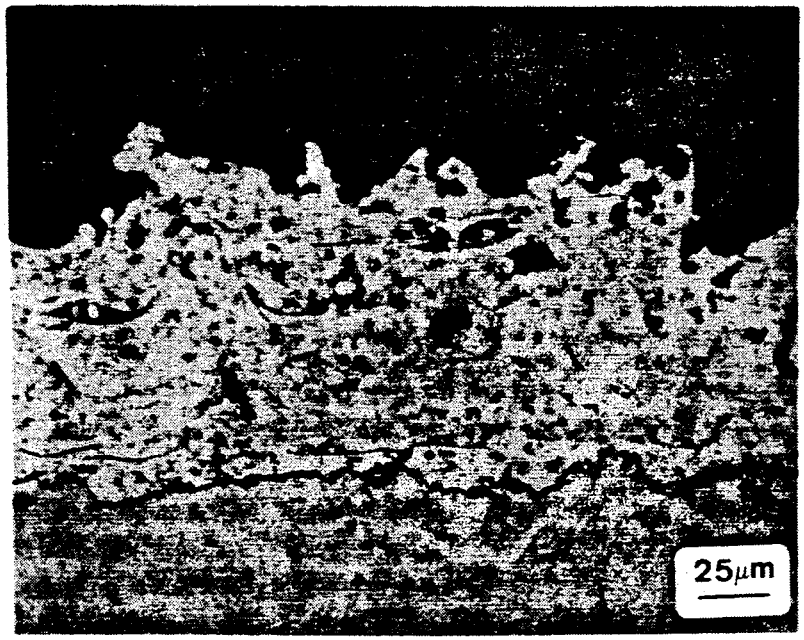
FIG. 2 is an optical light photomicrograph of a cross section of a direct current plasma sprayed preform composed of rapidly solidified aluminum based iron, vanadium and silicon containing alloy matrix deposited onto a low carbon steel sheet fabricated by the present invention.

Rapidly solidified powder having a US Standard Sieve Size ranging from No. 170-No. 325 (90–45 micrometers) and the composition aluminum balance, 4.06 at % iron, 0.70 at % vanadium, 1.51 at % silicon (hereinafter designated alloy A) was direct current (d.c.) plasma sprayed onto a low carbon steel sheet having the approximate dimensions of 0.2 cm.×5 cm. ×5 cm. Plasma spraying was performed at a powder feed rate of 20 grams/minutes at 35 kW to achieve a deposited layer approximately 0.02 cm. thick. FIG. 1 is a scanning electron photomicrograph of the surface of the d.c. plasma sprayed preform composed of rapidly solidified aluminum based iron, vanadium and silicon containing alloy matrix deposited onto the low carbon steel sheet. Individual areas or splats corresponding to solidified sprayed powder particles were observed. The coating was uniform and contiguous. FIG. 2 is an optical light photomicrograph of a cross section of the direct current plasma sprayed preform composed of rapidly solidified aluminum based iron, vanadium and silicon containing alloy matrix deposited onto the low carbon steel sheet. Some porosity was observed, however, discrete primary intermetallic compound particles were not seen in the alloy A microstructure, indicating that solidification of the plasma sprayed powder occurred at a rate rapid enough to suppress the formation of coarse primary dispersoid particles.

EXAMPLE II

Figure 3:
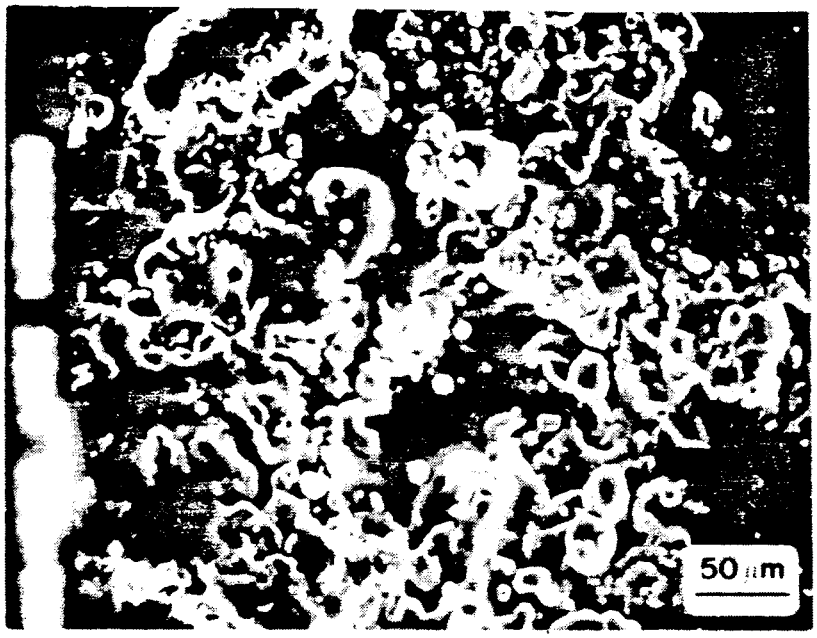
FIG. 3 is a scanning electron photomicrograph of the surface of an induction coupled plasma sprayed preform composed of rapidly solidified aluminum based iron, vanadium and silicon containing alloy matrix deposited onto planar flow cast aluminum based iron, vanadium and silicon containing ribbon fabricated by the present invention.
Figure 4:
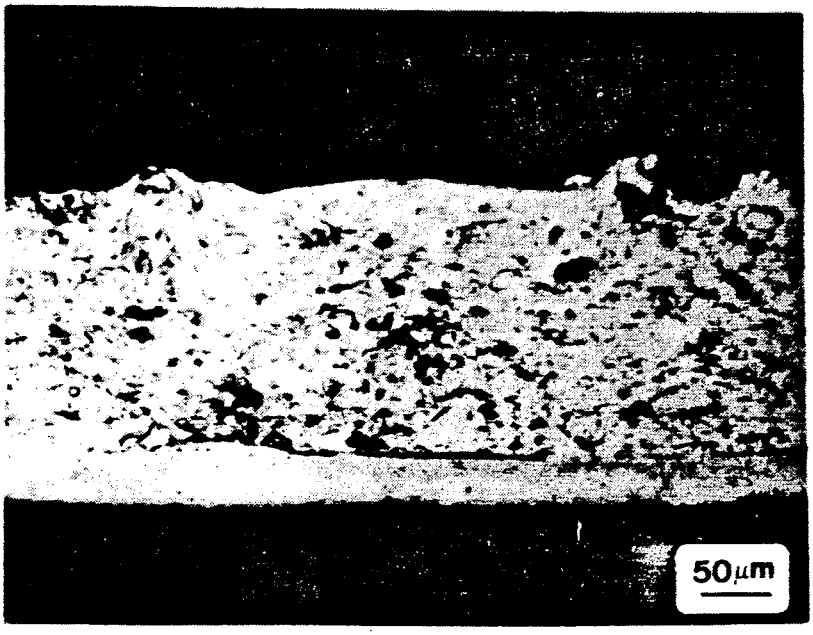
FIG. 4 is an optical light photomicrograph of a cross section of an induction coupled plasma sprayed preform composed of rapidly solidified aluminum based iron, vanadium and silicon containing alloy matrix deposited onto planar flow cast aluminum based iron, vanadium and silicon containing ribbon fabricated by the present invention.

Rapidly solidified powder having a US Standard Sieve Size less than No. 80 (180 micrometers) and a composition aluminum balance, 4.06 at % iron, 0.70 at % vanadium, 1.51 at % silicon (hereinafter designated alloy A) was induction coupled plasma sprayed onto a planar flow cast two inch wide ribbon composed of alloy A wrapped upon a mandrel approximately 30 cm. in diameter. Induction coupled plasma spraying was performed for approximately 10 minutes at 170 kW to achieve a deposited layer approximately 0.02 cm. thick. FIG. 3 is a scanning electron photomicrograph of the surface of the induction coupled plasma sprayed preform composed of rapidly solidified aluminum based iron, vanadium and silicon containing alloy matrix deposited onto planar flow cast aluminum based iron, vanadium and silicon containing ribbon. Individual areas or splats corresponding to solidified incident powder particles were observed. The coating was uniform and contiguous. FIG. 4 is an optical light photomicrograph of a cross section of the induction coupled plasma sprayed preform composed of rapidly solidified aluminum based iron, vanadium and silicon containing alloy matrix deposited onto planar flow cast aluminum based iron, vanadium and silicon containing ribbon. Some porosity was observed, however, discrete primary intermetallic compound particles were not seen in the alloy A microstructure indicating that solidification of the plasma sprayed powders occurred at a rate rapid enough to suppress the formation of coarse primary dispersoid particles.

EXAMPLE III

Figure 5:
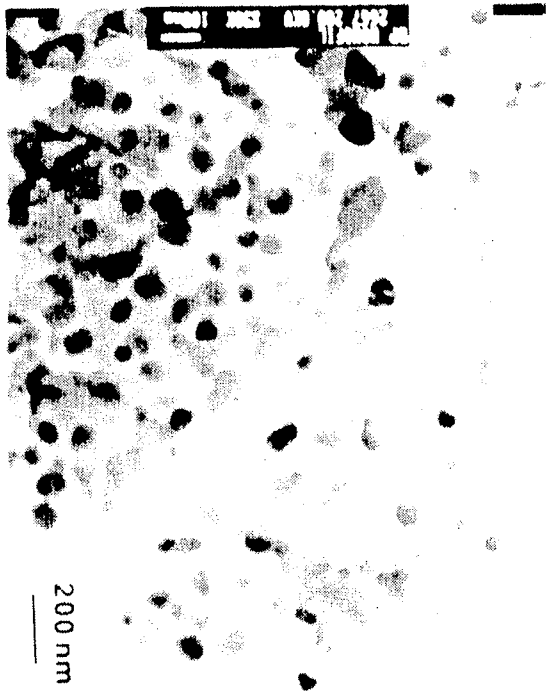
FIG. 5 is a transmission electron photomicrograph of an induction coupled plasma sprayed preform composed of rapidly solidified aluminum based iron, vanadium and silicon containing alloy fabricated by the present invention.

Transmission electron microscopy (TEM) was performed on induction coupled plasma sprayed coatings to further examine the microstructure of the deposited layer. Coatings were fabricated as in Example II. Samples were prepared by mechanically grinding off the planar flow cast alloy A substrate and thinning the sample to approximately 25 micrometers in thickness. TEM foils were prepared by conventional electro-polishing techniques in an electrolyte consisting of 80 percent by volume methanol and 20 percent by volume nitric acid. Polished TEM foils were examined in a Philips EM 400T electron microscope. A transmission electron photomicrograph of the induction coupled plasma sprayed coatings composed of rapidly solidified aluminum based iron, vanadium and silicon containing alloy fabricated by the present invention is shown in FIG. 5. The microstructure of the deposited layer is observed to be composed of fine 50–100 nm diameter $Al_{13}(Fe.V)_3Si$ dispersoids uniformly distributed in an aluminum solid solution matrix. This microstructure is very similar to that commonly observed in the planar flow cast, rapidly solidified alloy A ribbon as well as in components consolidated from rapidly solidified powder particles using powder metallurgical techniques.

Having thus described the invention in rather full detail, it will be understood that such detail need not be strictly adhered to but that further changes and modifications may suggest themselves to one skilled in the art, all falling within the scope of the invention as defined by the subjoined claims.

We claim:

1. A process for producing a rapidly solidified aluminum spray metallized coating, comprising the steps of:
(a) forming a rapidly solidified aluminum base alloy into a powder; and
(b) plasma spraying said powder onto a substrate.

2. A process as recited in claim 1, wherein said rapidly solidified alloy has a substantially uniform structure.

3. A process as recited in claim 2, wherein said rapidly solidified aluminum base alloy is prepared by a process comprising the steps of forming a melt of the aluminum base alloy and quenching the melt on a moving chill surface at a rate of at least $10^{5°}$ C./sec.

4. A process as recited in claim 1, wherein said alloy coating is not subjected to subsequent thermal treatment.

5. A process as recited in claim 1 wherein said powder forming step comprises the step of quenching a melt of said alloy on an impinging gas or liquid at a rate of at least about $10^{5°}$ C./sec.

6. A process as recited in claim 3, wherein said rapidly solidified alloy is pulverized to form said powder.

7. A process as recited by claim 6, wherein said powder has a U.S. Standard Sieve Size ranging from No. 60 to 325 (250 to 45 micrometers).

8. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 8.5 at %, "b" ranges from 0.25 to 5.5 at %, "c" ranges from 0.05 to 4.25 at % and the balance is aluminum plus incidental impurities, with the proviso that the ratio [Fe+X]:Si ranges from about 2.0:1 to 5.0:1.

9. A process as recited in claim 8, wherein said rapidly solidified aluminum based alloy is selected from the group consisting of the elements Al-Fe-V-Si, wherein the iron ranges from about 1.5–8.5 at %, vanadium ranges from about 0.25–4.25 at %, and silicon ranges from about 0.5–5.5 at %.

10. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a" ranges from 1.5–7.5 at %, "b" ranges from 0.75–9.5 at %, "c" ranges from 0.25–4.5 at % and the balance is aluminum plus incidental impurities, with the proviso that the ratio [Fe+X]:Si ranges from about 2.0:1 to 1.0:1.

11. A Process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, Ce, Ni, Zr, Hf, Ti, Sc, "a" ranges from 1.5–8.5 at %, "b" ranges from 0.25–7.0 at %, and "c" ranges from about 0.05 to 4.25 at %, the balance being aluminum plus incidental impurities.

12. A process as recited in claim 3, wherein said rapidly solidified aluminum based alloy has a composition consisting essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

13. A process as recited in claim 3, wherein said rapidly solidified aluminum based alloy has a composition consisting essentially of the formula $Al_{bal}Zr_aLi_bMg_cT_d$, wherein T is at least one element selected from the group consisting of Cu, Si, Sc, Ti, B, Hf, Cr, Mn, Fe, Co and Ni, "a" ranges from 0.05–0.75 at %, "b" ranges from 9.0–17.75 at %, "c" ranges from about 0.45–8.5 at % and "d" ranges from about 0.05–13 at %, the balance being aluminum plus incidental impurities.

14. A process as recited in claim 1, wherein said powder is composed of said rapidly solidified aluminum alloy combined with the particles of a reinforcing material present in an amount ranging from about 0.1 to 50 percent by volume, said powder having been ball milled to enfold metal matrix material around each of said particles.

15. A process as recited in claim 1, wherein said plasma spraying step comprises the steps of (i) ionizing an inert gas to generate a plasma; (ii) injecting said powder into said plasma; (iii) controlling the residence time of said powder within said plasma to cause said powder to reach a molten state; and (iv) directing said molten powder onto said substrate.

16. A process as recited in claim 15, wherein said powder has a U.S. Standard Sieve Size less than No. 3.5 (5.6 millimeters).

17. A process as recited in claim 15, wherein said gas is ionized using a direct current, an induction coupled or radio frequency power source.

18. A process as recited in claim 17, wherein said power source is a direct current power source having a power level ranging from 20 to 40 kW.

19. A process as recited in claim 18, wherein said power level ranges from 25 to 35 kW.

20. A process as recited in claim 17, wherein said power source is an induction coupled power source having a power level ranging from 140 to 200 kW.

21. A process as recited in claim 18, wherein said power level ranges from 150 to 170 kW.

22. A spray metallized coating formed from plasma spraying a rapidly solidified aluminum alloy onto a substrate.

23. A spray metallized coating as recited in claim 22, wherein said coating exhibits, in combination, excellent corrosion and oxidation resistance and improved elevated temperature strength and thermal stability.

24. A spray metallized coating as recited in claim 23, wherein said coating is applied to a substrate that is a continuous, woven, whisker or particulate reinforcement.

25. A spray metallized coating as recited in claim 23, wherein said coating is applied to a substrate to repair a surface defect thereof.

26. A spray metallized coating as recited in claim 25, wherein the substrate is a rapidly solidified aluminum alloy.

27. A spray metallized coating as recited in claim 22, wherein said alloy is an aluminum-iron-vanadium silicon alloy.

* * * * *